United States Patent [19]

Yoshihara

[11] Patent Number: 5,068,762

[45] Date of Patent: Nov. 26, 1991

[54] ELECTROPHOTOGRAPHIC CHARGING DEVICE

[75] Inventor: Toshiyuki Yoshihara, Mitaka, Japan

[73] Assignee: Canon Kabushiki Kaisha, Tokyo, Japan

[21] Appl. No.: 438,045

[22] Filed: Nov. 20, 1989

[30] Foreign Application Priority Data

Nov. 22, 1988 [JP] Japan ..... 63-296739

[51] Int. Cl.[5] ..... G03G 15/02

[52] U.S. Cl. ..... 361/225; 430/31; 430/56; 430/902; 430/58; 430/59; 355/219

[58] Field of Search ..... 430/31, 56, 902; 361/225; 355/219

[56] References Cited

U.S. PATENT DOCUMENTS 2,892,973 6/1959 Straughan ..... 430/902 X
3,108,894 10/1963 Stowell ..... 361/225
4,904,557 2/1990 Kubo ..... 430/56

FOREIGN PATENT DOCUMENTS 0312230 4/1989 European Pat. Off. ..... 355/219

*Primary Examiner*—Roland Martin
*Attorney, Agent, or Firm*—Fitzpatrick, Cella, Harper & Scinto

[57] ABSTRACT

An electrophotographic device has an electrophotographic photosensitive member and a blade for charging arranged in contact with the photosensitive member, the photosensitive member being charged by application of a voltage on the blade for charging, wherein the ten point surface average roughness Rz of the photosensitive member is 0.3 μm to 5.0 μm.

14 Claims, 1 Drawing Sheet

ELECTROPHOTOGRAPHIC CHARGING DEVICE

BACKGROUND OF THE INVENTION

1. Field of the invention

This invention relates to an electrophotographic device, particularly to an electrophotographic device to be used in contact charging process.

2. Related Background Art

The main stream of the charging process in the electrophotographic system is by way of corona discharging, but in this system, there are involved such problems as denaturation of the photosensitive member on account of corona products such as ozone, NOx, etc. during corona generation, influence of the discharging wire on image quality, formation of white drop-outs on black streaks on image, etc. Also, there is the drawback that efficiency is poor in power energy.

For compensation of such drawbacks, there have been studied in the prior art the method of direct charging, and a large number of proposals have been made (Japanese Laid-open Patent Application Nos. 57-178267, 56-104351, 58-40566, 58-139156, 58-150975, etc.). This method is to charge the photosensitive member surface by applying a voltage with the member for charging in contact with the electrophotographic photosensitive member. As the shape of the member for charging, such shape as roller, brush (including magnetic brush), plate blade, belt, etc. can be taken, but in view of miniaturization of the electrophotographic device, a plate blade shape is preferred among them. This is because, a nip width enough to obtain better charging characteristic with small space can be taken as compared with other shapes.

However, when charging is effected by use of a blade for charging, through the friction between the photosensitive member surface and the blade contacting portion, reversal of the blade (turnover) or the chatter phenomenon occurs, whereby there is the problem that no good image can be obtained. In the case of a cleaning blade to be used in the cleaning process, the frictional force between the photosensitive member and the blade can be alleviated due to the presence of a toner or a lubricant therebetween, but since nothing exists between the photosensitive member and the blade in the direct charging process, it is more disadvantageous for blade reversal and the chatter phenomenon.

SUMMARY OF THE INVENTION

An object of the present invention is to provide an electrophotogaphic device which can prevent the reversal of the blade for charging which is arranged in contact with electrophotographic photosensitive member and the chatter phenomenon to give good images.

It is also another object of the present invention is to provide an electrophotographic device excellent in repeated durability.

More specifically, the present invention is an electrophotographic device having an electrophotogaphic photosensitive member and a blade for charging arranged in contact with said photosensitive member, said photosensitive member being charged by application of a voltage on the blade for charging, wherein the ten point surface average roughness Rz of said photosensitive member is 0.3 μm to 5.0 μm.

DETAILED DESCRIPTION OF THE INVENTION

Figure 1:
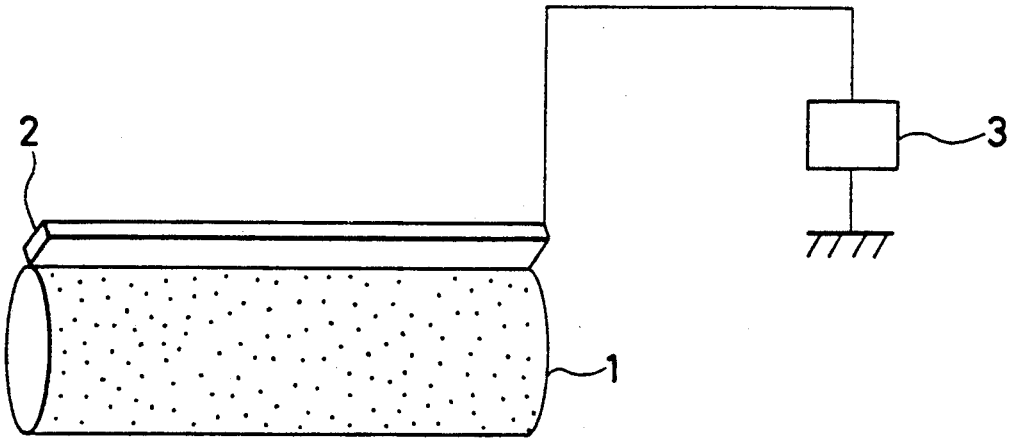
FIG. 1 is a schematic illustration of the constitution of the electrophotographic device in the present invention.

The surface of the photosensitive member is generally very smooth. For lowering the frictional coefficient of the smooth surface, roughness was imparted to the photosensitive member surface in the present invention. In this way, the contact points between the blade for charging and the photosensitive member surface were decreased, whereby the frictional force could be lowered.

In the case when the cleaning blade is in contact with the photosensitive member in the so called cleaning step, because of the presence of the gap between the cleaning blade and the photosensitive surface and untransferred toner therearound, frictional force is lowered even at the smooth surface, whereby reversal of the blade or the chatter phenomenon will scarcely occur.

Also, the frictional force can be lowered by interposing a lubricant such as fluorine resin powder between the blade and the photosensitive member. However, although this method may be effective in cleaning blade, it is not preferable in the case of a blade for charging, because charging irregularity is formed if there exists such powder between the blade and the photosensitive member.

As the means for roughening the photosensitive member surface, there may be included, for example, the following methods.

(1) The photosensitive member surface is roughened by a mechanical polishing means. For example, there are the methods of slide polishing with a polishing agent and the sand blast method.

(2) The substrate of the photosensitive member is roughened on surface by the horning working or the sand blast method, and a photosensitive layer or a surface layer is formed thereon to effect surface roughening.

(3) When the photosensitive member surface layer is constituted primarily of a resin, electrically inert particles are dispersed into the resin. As the material using such dispersed particles, there may be included silica, metal oxides of metals such as alumina, zirconia, etc., and resin powder of tetrafluoroethylene, polyvinylidene fluoride, polystyrene, silicone resin, etc.

(4) When the photosensitive member surface layer is primarily constituted of a resin, coacervation is caused to occur in the resin layer. This is to obtain a highly controlled rough surface state according to coacervation, in which a coated layer of a resin solution containing a low viscosity resin and a high viscosity resin is formed and the high viscosity resin component is coacervate.

The ten point surface average roughness Rz of the photosensitive member necessary for prevention of the blade reversal or the chatter phenomenon is 0.3 μm to 5.0 μm, particularly preferably 0.5 μm to 2.0 μm. The ten point surface average roughness Rz as herein mentioned is defined by the JIS standard B0601. Also, measurement was conducted by means of a universal surface shape measuring machine (SE-3C, manufactured by Kosaka Kenkyusho) according to the JIS standard B0601.

When Rz of the photosensitive member is smaller than 0.3 μm, because the photosensitive surface is flat, friction between the blade for charging and the photosensitive member surface will not be substantially relaxed. On the other hand, when Rz of the photosensitive member is larger than 5 μm, image defect caused by the roughness of the photosensitive member will be formed.

Figure 2:
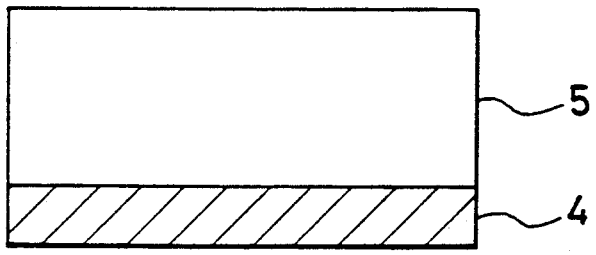
FIG. 2 is a schematic illustration of the layer constitution of the electropotographic photosensitive member.

The electrophotographic photosensitive member in the present invention is primarily constituted of the mode having a photosensitive layer 5 on an electroconductive substrate 4 as shown in FIG. 2. The photosensitive layer 5 can be formed by vapor depositing an inorganic photoconductive material such as selenium, a selenium alloy, amorphous silicon, cadmium sulfide, zinc oxide, etc., or by coating a dispersion thereof in a resin having film forming property. The photosensiive layer 5 can be formed as a single layer containing a charge generation substance such as azo pigment, phthalocyanine pigment, anthanthrone pigment, thiopyrilium dye, etc. and a charge transport substance such as hydrazone, stilbene, pyrazoline, etc. which are mixed in the same layer by the use of a resin having film forming property, or as a laminate of the layers containing separately the respective substances.

Further, on the photosensitive layer 5, it is also possible to provide separately a protective layer or an insulating layer such as vapor deposited film or resin coating of a metal oxide, nitride, etc.

As the electroconductive substrate 4, materials having electroconductivity, for example, metals or metal alloys such as aluminum, aluminum alloy, stainless steel, etc. can be used. Further, plastics having a metal or a metal alloy provided thereon, or plastics, papers, metals, metal alloys provided with an electroconductive particle containing layer can be also used.

The shape of the electroconductive substrate may be either cylindrical or in the form of sheet.

A subbing layer can be provided between the electroconductive substrate 4 and the photosensitive layer 5 to improve barrier characteristics as well as adhesion.

As the material of the blade for charging, there may be employed those which are made electroconductive by having carbon, acetylene black, metal, metal oxide or electroconductive polymer dispersed in rubber. As the rubber material, silicone rubber, urethane rubber, chloroprene rubber, butyl rubber, fluorine rubber and EPDM are preferred.

The resistance of the blade for charging, which is brought into contact with the photosensitive member, may be preferably $10^0$ to $10^{12}$ ohm.cm, optimally within the range from $10^2$ to $10^{10}$ ohm.cm from the standpoints of good charging and prevention of dielectric breakdown.

The basic constitution of the electrophotographic device of the present invention is shown in FIG. 1.

The blade for charging 2 is arranged in contact with the electrophotographic photosensitive member 1, and charging is effected on the photosensitive member 1 with the voltage applied from a connected external power source 3.

Figure 3:
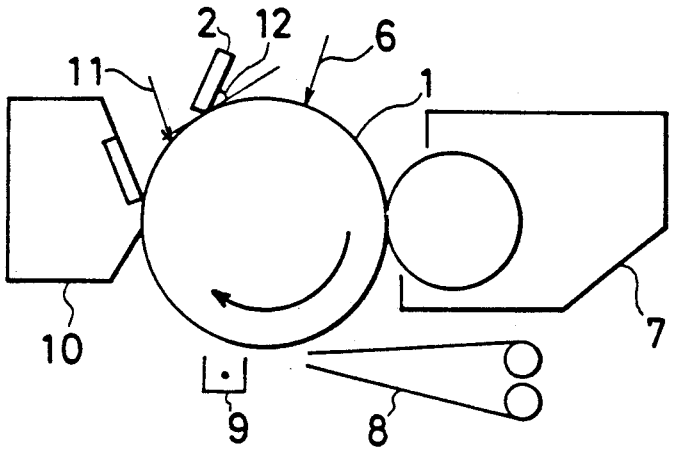
FIG. 3 is a schematic illustration of the image forming device by use of the electrophotographic device of the present invention.

A specific example of the image forming device by use of the electrophotographic device of the present invention is shown in FIG. 3.

This device has the blade for charging 2, the image exposure means 6, the developer 7, the paper feeding roller and paper feeding guide 8, the transfer charger 9 and the cleaner 10 arranged on the peripheral surface of the electrophotographic photosensitive member 1. The method for image formation comprises first applying a voltage on the blade for charging 2 arranged in contact with the electrophotographic photosensitive member 1 to charge the surface of the photosensitive member 1, image exposing an image corresponding to the original onto the photosensitive member 1 by the image exposure means 6 to form an electrostatic latent image. Next, by attaching to the photosensitive member 1 the toner in the developing instrument 7, the electrostatic latent image on the photosensitive member 1 is developed (visualized). Further, the toner image formed on the photosensitive member 1 is transferred by means of the transfer charger 9 onto a transfer material fed, for example, paper, by passing through the paper feeding roller and the paper feeding guide 8. Also, the residual toner remaining on the photosensitive member 1 without transfer is recovered by the cleaner 10. On the other hand, the transfer material having the toner image formed thereon is delivered to a fixing instrument (not shown) to fix the toner image. When residual charges remain internally of the photosensitive member, it is preferably to effect deelectrification by exposing the photosensitive member 1 to light by means of the above exposure means 11.

In such image forming device, as the light source of the image exposure means 6, halogen light, fluorescent light lamp, laser beam, etc. can be used. Another auxiliary process may be added, if necessary.

The electrophotographic device of the present invention can be applied widely to electrophotographic application fields such as electrophotographic copying machines, laser beam printers, LED printers, CRT printers, electrophotographic plate making systems, etc.

The present invention is described below in more detail by referring to Examples.

EXAMPLE 1

A blade for charging shaped in plate form of 1.2 mm in thickness and 230 mm in width was molded from urethane rubber containing carbon dispersed therein. The rubber hardness was 65° and the volume resistivity value was $10^6$ ohm.cm.

Next, an electroconductive coated layer was provided on a cylinder made of aluminum with a diameter of 30 mm and a length of 260 mm. This was formed by coating and drying a mixture of an electroconductive pigment comprising tin oxide, a phenol resin (trade name: Priofen J-325, manufactured by Dainippon Ink) and a solvent mixture of methanol and methyl cellosolve mixed at a ratio of 1:1 (weight ratio, hereinafter the same), containing them at a ratio of 1:1:2, as the coating material. The film thickness was 20 μm.

Next, a subbing layer was formed by coating a mixture of a polyamide resin (trade name: Amylan CM-8000, manufactured by Toray) and a solvent mixture of methanol and n-butanol mixed to a ratio of 3:1, containing them at a ratio of 8:92, as the coating material. The film thickness was 0.6 μm.

Next, a charge generation layer was formed by coating a disazo pigment of the following structural formula:

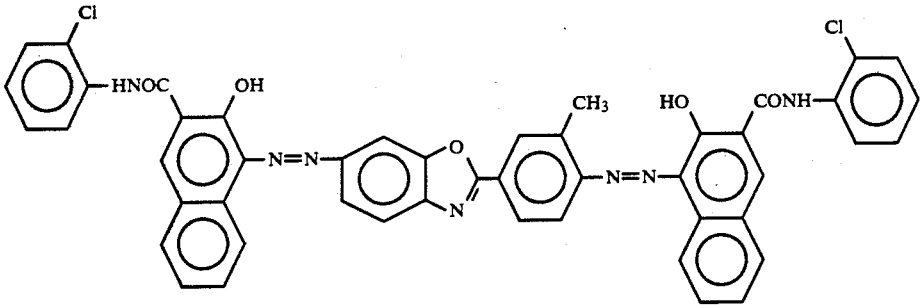

a butyral resin (trade name: S-Lec BM-S, manufactured by Sekisui Kagaku) and a solvent mixture of cyclohexanone and THF mixed to a ratio of 1:1, containing them at a ratio of 2:1:97, as the coating material. The film thickness was 0.2 μm.

Next, as the charge transport layer, a charge transport layer was formed by coating a mixture of a hydrazone-acrylic resin (trade name: MS-200, manufactured by Shinnippon Seitetsu Kagaku) of the following formula:

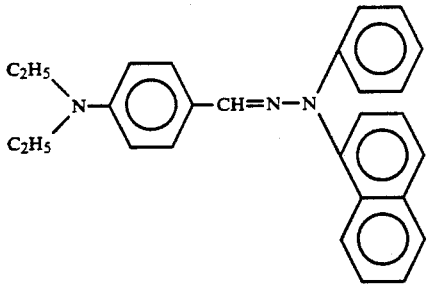

and monochlorobenzene and dichloroethane mixed at a ratio of 3:1 as the coating material. The film thickness was 19 μm. The electrophotographic photosensitive member thus obtained was polished with a lapping tape (trade name: C-2000, manufactured by Fuji Shashin Film) to ten point surface average roughness Rz of 0.2 μm, 0.3 μm, 0.5 μm, 2.0 μm, 5.0 μm, 6.0 μm, respectively. A photosensitive member in which surface polishing was not applied (ten point surface average roughness Rz: 0 μm) was also prepared.

Next, the blade for charging as described above was assembled in an electrophotographic copying machine prepared by modifying FC-5 manufactured by Canon to the arrangement shown in FIG. 1, and set at a contact angle to the photosensitive member of 25°, an edge contact with a penetration amount of 1.0 mm and a line pressure of 24 g/cm.

The photosensitive member as described above was mounted on the copying machine, charged by a blade for charging to an initial surface potential of −700 V, and image formation was effected for 1000 sheets. The evaluation environment was 22° C. and 55% RH. The results are shown in Table 1.

TABLE 1

| Photo-sensitive member No. | Rz (μm) | Reversal of blade for charging | Image quality |
|---|---|---|---|
| 1 | 0 | generated after 20 sheet copying | good before blade reversal |
| 2 | 0.2 | generated after 30 sheet copying | good before blade reversal |
| 3 | 0.3 | not generated up to 4000 sheet copying | good |
| 4 | 0.5 | not generated up to 10000 sheet copying | good |
| 5 | 2.0 | not generated up to 10000 sheet copying | good |
| 6 | 5.0 | not generated up to 10000 sheet copying | good |
| 7 | 6.0 | not generated up to 10000 sheet copying | wholly roughened |
| 8 | 8.0 | not generated up to 10000 sheet copying | wholly markedly roughened |

EXAMPLE 2

In the copying machine used in Example 1, the blade for charging was set at a contact angle 12 of 130°, an edge contact of a penetration amount of 0.9 mm and and a line pressure of 20 g/m. Each of the photosensitive members No. 1 and 5 prepared in Example 1 was mounted on the device and image evaluation was similarly performed. In this case, since the blade for charging is in contact with the photosensitive member in the forward direction, no reversal occurred in the photosensitive member No. 1, but on account of great frictional force, the charging blade could not follow the rotation of the photosensitive member, whereby the so called chatter phenomenon occurred. As the result, only images with remarkably great charging irregularity could be obtained.

On the other hand, with the photosensitive member No. 5, good image could be obtained.

EXAMPLE 3

A photosensitive member was prepared similarly as in Example 1 up to the charge generation layer. Next, the coating material for formation of charge transport layer was prepared as described in Example 1. To this material was added spherical silicon resin powder with a particle diameter of 2 μm (trade name: Tospal 120, manufactured by Toshiba Silicon) in an amount of 15 wt. % based on the solid components of the coating material for formation of charge transport layer, followed by coating and drying of the resultant mixture to form a charge transport layer. The film thickness was 19 μm.

The photosensitive member thus prepared is referred to as No. 9. The ten point surface average roughness Rz was found to be 1.8 μm. A photosensitive member was prepared similarly as in Example 1 up to the charge transport layer, and further a protective layer was provided thereon to prepare a photosensitive member. The protective layer was formed by coating and drying a mixture of a phenol resin (trade name: Priofen J-325, manufactured by Dainippon Ink), a butyral resin (trade name: Ethlec BM-2, manufactured by Sekisui Kagaku) as the high viscosity resin, and a solvent mixture of methanol and 2-methoxymethanol mixed at a ratio of 1:1, containing them at a ratio of 50:5:200. The film thickness was 2 μm. This is called the photosensitive member No. 10. The ten point surface average roughness Rz was found to be 0.9 μm.

Except for using these photosensitive members in place of the photosensitive members No. 1–8, image formation and evaluation were conducted according to the same methods as described in Example 1.

The results are shown in Table 2.

TABLE 2

| Photosensitive member No. | Rz (μm) | Reversal of blade for charging | Image quality |
|---|---|---|---|
| 9 | 1.8 | not generated up to 10000 sheet copying | good |
| 10 | 0.9 | not generated up to 10000 sheet copying | good |

EXAMPLE 4

As the substrate, an aluminum cylinder of 80 mm in diameter, 360 mm in length and 2 mm in thickness was prepared, and mirror working was applied on its surface and then sand blast working was applied. This was fixed at a predetermined position in a glow discharge vapor tank. Next, the tank was evacuated to a vacuum degree of about $5\times10^{-4}$ torr. Then, the input voltage of the heater was raised to stabilize the substrate temperature to 150° C. Thereafter, hydrogen gas and silane gas (15 vol. % based on hydrogen gas) were introduced into the tank, and the pressure was stabilized to 0.5 torr by adjusting the gas flow amounts and the vapor tank main valve. Next, a high frequency power of 5 MHz was thrown into the induction coil to generate glow discharging internally of the coil, thereby giving an input power of 30 W. An amorphous silicon film was permitted to grow on the substrate under the above conditions, and after the same conditions were maintained until the film thickness became 30 μm, glow discharging was discontinued.

The ten point surface average roughness Rz of the amorphous silicon photosensitive member thus prepared was found to be 1.5 μm. This is called the photosensitive member No. 11. Also, for comparative purpose, a photosensitive member was prepared by forming an amorphous silicon film on a substrate not subjected to the sand blast working. This is referred to as the photosensitive member No. 12.

On the other hand, a blade for charging was molded by use of an EPDM (ethylene-propylene-diene ternary copolymer) to a thickness of 1.0 mm and a length of 330 mm. The rubber hardness was 70° and the volume resistivity value $10^6$ ohm.cm.

The blade for charging was assembled in an electrophotogaphic copying machine NP-3525 manufactured by Canon modified to the arrangement shown in FIG. 3, and set at two contact angles of 25° and 130°, both in flank contact with each other. The line pressure was made 24 g/cm.

With the photosensitive member as described above mounted on the copying machine, charging was effected by a blade for charging to an initial surface potential of −700 V, and image formation was carried out for 1000 sheets. The evaluation environment was the same as in Example 1.

The results are shown in Table 3.

TABLE 3

| Photosensitive member No. | Rz (μm) | Reversal of blade for charging: Contact angle 25° | Reversal of blade for charging: Contact angle 130° | Image quality |
|---|---|---|---|---|
| 11 | 1.5 | not reversed | no chatter | good |
| 12 | 0 | reversed after 10 sheet copying | chatter | image irregularity caused by charging irregularity |

As described above, according to the present invention, good images can be obtained repeatedly by preventing the reversal of the blade for charging for effecting direct charging and the chatter phenomenon.

What we claim is:

1. An electrophotographic device having an electrophotographic photosensitive member and a blade for charging arranged in contact with said photosensitive member, said photosensitive member being charged by application of a voltage on the blade for charging, wherein the ten point surface average roughness Rz of said photosensitive member is 0.3 μm to 5.0 μm.

2. An electrophotographic device according to claim 1, wherein the ten point surface average roughness Rz is 0.5 μm to 2.0 μm.

3. An electrophotographic device according to claim 1, wherein said photosensitive member comprises a photosensitive layer, the photosensitive layer consisting of a single layer.

4. An electrophotographic device according to claim 3, wherein the photosensitive layer contains an organic photoconductive substance.

5. An electrophotographic device according to claim 3, wherein the photosensitive layer comprises (i) a charge generation substance selected from the group consisting of azo pigments, phthalocyanine pigments, anthanthrone pigments and thiopyrilium dyes and (ii) a charge transport substance selected from the group consisting of hydrazone, stilbene and pyrazoline.

6. An electrophotographic device according to claim 1, wherein the photosensitive layer is a laminate of a charge generation layer and a charge transport layer.

7. An electrophotographic device according to claim 6 wherein the charge generation layer contains a charge generation substance selected from the group consisting of azo pigments, phthalocyanine pigments and thiopyrilium dyes and the charge transport layer contains a charge transport substance selected from the group consisting of hydrazone, stilbene and pyrazoline.

8. An electrophotographic device according to claim 1, wherein the photosensitive layer has a protective layer provided thereon.

9. An electrophotographic device according to claim 1, wherein the electroconductive substrate is a metal or a metal alloy selected from the group consisting of aluminum, aluminum alloy and stainless steel.

10. An electrophotographic device according to claim 1, wherein a subbing layer is provided between the electroconductive substrate and the photosensitive layer.

11. An electrophotographic device according to claim 1, wherein the blade for charging is a rubber selected from the group consisting of silicone rubber, urethane rubber, chloroprene rubber, butyl rubber, fluorine rubber and EPDM.

12. An electrophotographic device according to claim 11, wherein the blade for charging contains at least one selected from the group consisting of carbon, acetylene black, metal, metal oxide and electroconductive polymer.

13. An electrophotographic device according to claim 1, wherein the blade for charging has a resistance of 1 to $10^{12}$ ohm.cm.

14. An electrophotographic device according to claim 1, wherein the blade for charging has a resistance of $10^{2}$ to $10^{10}$ ohm.cm.

* * * * *

UNITED STATES PATENT AND TRADEMARK OFFICE

CERTIFICATE OF CORRECTION

PATENT NO. : 5,068,762

DATED : November 26, 1991

INVENTOR(S) : TOSHIYUKI YOSHIHARA

It is certified that error appears in the above-identified patent and that said Letters Patent is hereby corrected as shown below:

COLUMN 1

Line 17, "on" (second occurrence) should read --or--.

COLUMN 2

Line 24, "so called" should read --so-called--.

COLUMN 4

Line 31, "preferably" should read --preferable--.
Line 32, "the above" should be deleted.

COLUMN 6

Line 43, "and and" should read --and--.
Line 52, "so" should read --so- --.

COLUMN 7

Line 51, "thrown" should read --applied--.

UNITED STATES PATENT AND TRADEMARK OFFICE

CERTIFICATE OF CORRECTION

PATENT NO. : 5,068,762

DATED : November 26, 1991

INVENTOR(S) : TOSHIYUKI YOSHIHARA

It is certified that error appears in the above-identified patent and that said Letters Patent is hereby corrected as shown below:

COLUMN 8

Line 33, "we" should read --I--.
Line 63, "6 wherein" should read --6, wherein--.

Signed and Sealed this

Fifteenth Day of June, 1993

*Attest:*

Michael K. Kirk

MICHAEL K. KIRK

*Attesting Officer*

*Acting Commissioner of Patents and Trademarks*